US006346013B1

(12) United States Patent
Zhang et al.

(10) Patent No.: US 6,346,013 B1
(45) Date of Patent: Feb. 12, 2002

(54) AUDIO JACK HAVING SECURELY RETAINED CONTACTS THEREIN

(75) Inventors: Jiang-Qiang Zhang; Li-Qi Liu, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/960,600

(22) Filed: Sep. 20, 2001

(51) Int. Cl.[7] ..... H01R 24/04
(52) U.S. Cl. ..... 439/668
(58) Field of Search ..... 439/668, 669, 439/108, 733.1

(56) References Cited

U.S. PATENT DOCUMENTS 5,092,795 A * 3/1992 Kitagawa ..... 439/668
6,077,126 A * 6/2000 Peng ..... 439/668
6,244,905 B1 * 6/2001 Wang ..... 439/668

* cited by examiner

*Primary Examiner*—Tho D. Ta
(74) *Attorney, Agent, or Firm*—Wei Te Chung

(57) ABSTRACT

An audio jack designed to be located between a printed circuit board and a fixing portion of an electronic device for fixing the audio jack. The audio jack includes a housing (1) and a number of contacts (21, 22, 23, 24, 25) retained in the housing. The housing defines a plug-insertion hole. Each contact includes a base (213, 223, 232, 242, 251), a projecting portion (214, 224, 236, 243, 255) projecting from the base and a tail portion (216, 225, 235, 246, 253) for resiliently abutting against the printed circuit board. At least one of the contacts has a locating tab (211, 221, 231, 244) bent from the base thereof and retained in the housing for preventing movement of the contact relative to the housing in a top-to-bottom direction.

6 Claims, 5 Drawing Sheets

AUDIO JACK HAVING SECURELY RETAINED CONTACTS THEREIN

FIELD OF THE INVENTION

The present invention relates to the art of electrical connectors, and in particular to an audio jack having securely retained contacts therein.

BACKGROUND OF THE INVENTION

A jack generally includes an insulative housing and a plurality of terminals mounted in the housing. Each terminal usually has a contact portion for contacting a mating connector (e.g. a plug) and a mounting portion engaging with an electronic device for electrically interconnecting the audio jack and the electronic device.

Such a conventional audio jack is shown in FIG. 5. In this prior art, a jack comprises an insulating housing 10' and a plurality of contacts 20'. The housing 10' defines a longitudinal plug-insertion hole (not labeled) therethrough for receiving a mating plug (not shown). A plurality of contact-receiving grooves 102' are defined in the housing 10' and communicate with outside through a bottom 101 ' of the housing 10'. Each contact includes a base 202' and a tail portion 201' extending from the base 202' for resiliently and electrically engaging with appropriate circuit traces on a top surface of a printed circuit board (not shown). The contacts 20' are respectively received in corresponding grooves 102', and the tail portions 201' each extend out of the housing 10' from the bottom 101' of the housing 10'. In assembly, the audio jack is retained between the circuit board and a fixing portion of an electronic device (not shown). With the housing 10' of the audio jack thus retained, the fixing portion of the electronic device presses an upper surface of the audio jack downwardly so that the tail portions 201 ' resiliently and electrically connect the appropriate circuit traces on the circuit board. In this way, the audio jack connect electrically the circuit board without requiring solder to fix the contacts to the circuit traces.

However, because the contact-receiving grooves communicate with outside through the bottom of the housing, the contacts received in the contact-receiving grooves cannot be securely retained in the housing, resulting in undesired movement of the contacts relative to the housing in a top-to-bottom direction and unreliable connection with the plug.

This invention is directed to an improved audio jack having locating tab for securely retaining the contacts in the housing thereof, which obviates undesired movement of the contacts in the housing.

SUMMARY OF THE INVENTION

A main object of the present invention is to provide a new and improved audio jack having securely retained contacts therein.

Another object of the present invention is to provide an audio jack for reliable connection between a mating plug and a printed circuit board.

Further object of the present invention is to provide an audio jack for conveniently interconnecting the audio jack with the printed circuit board.

An audio jack in accordance with the present invention comprises an insulating housing, a number of contacts received in the housing. The housing defines a longitudinal plug-insertion hole therethrough for receiving a mating plug. A plurality of contact-receiving grooves are defined in the housing. A plurality of retaining grooves respectively and perpendicularly communicate with corresponding contact-receiving grooves. Each contact includes a base, a tail portion and a projecting portion projecting from the base. At least one of the contacts has a locating tab bent from the base thereof. The at least one of locating tab is retained in the retaining groove for preventing movement of the contact relative to the housing in a top-to-bottom direction. The tail portions each form a contact tab on a distal end thereof for resiliently and electrically engaging with appropriate circuit traces on a top surface of a printed circuit board.

In use, the audio jack is retained between the circuit board and a fixing portion of an electronic device for retaining in the housing of the audio jack. The fixing portion of the electronic device downwardly presses the audio jack so that the contact tabs resiliently and electrically engage with the appropriate circuit traces on the top surface of the printed circuit board. In this way, the audio jack engages electrically with a predetermined position on the circuit board without requiring solder to fix the contacts to the circuit traces. The at least one of the contacts is securely retained in the housing by the locating tab thereof received in the retaining groove.

Other objects, advantages and novel features of the invention will become more apparent from the following detailed description when taken in conjunction with the accompanying drawings.

DETAILED DESCRIPTION OF THE INVENTION

Figure 1:
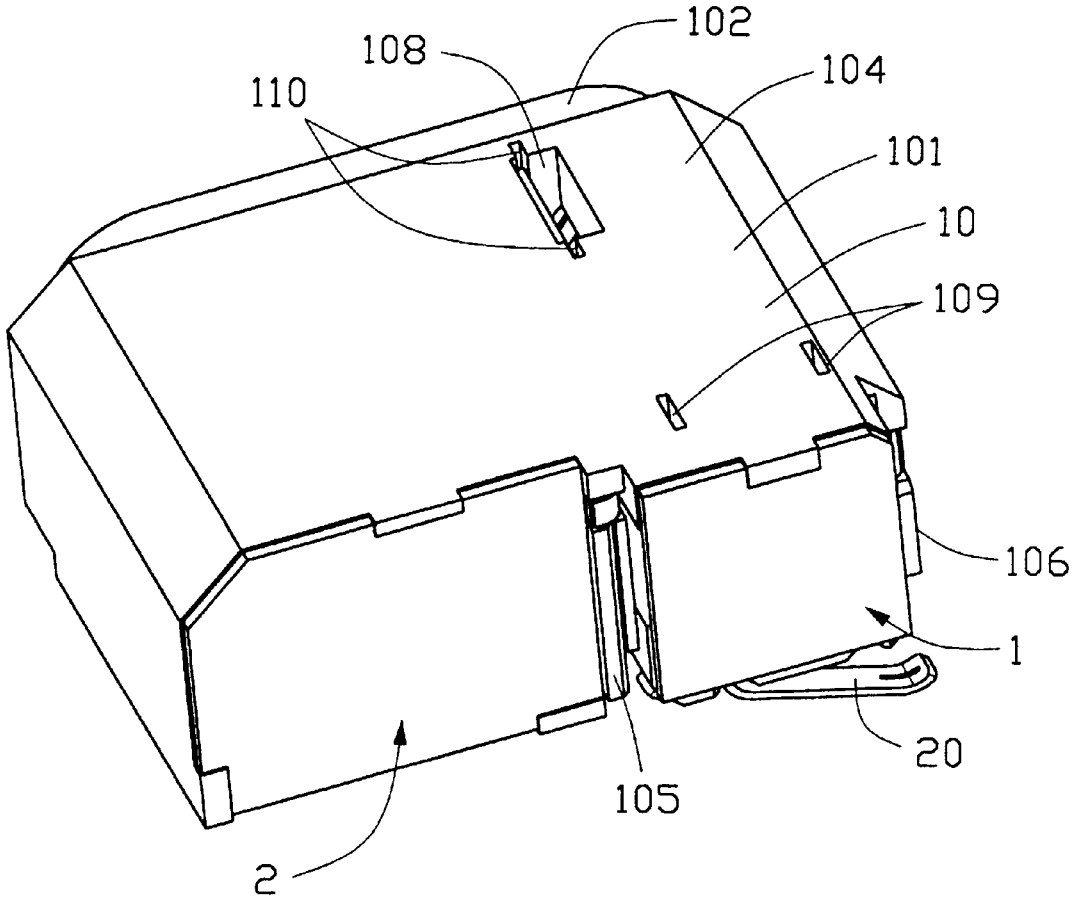
FIG. 1 is a perspective view of an electrical connector assembly, wherein an audio jack of the present invention is assembled in the electrical connector assembly.
Figure 2:
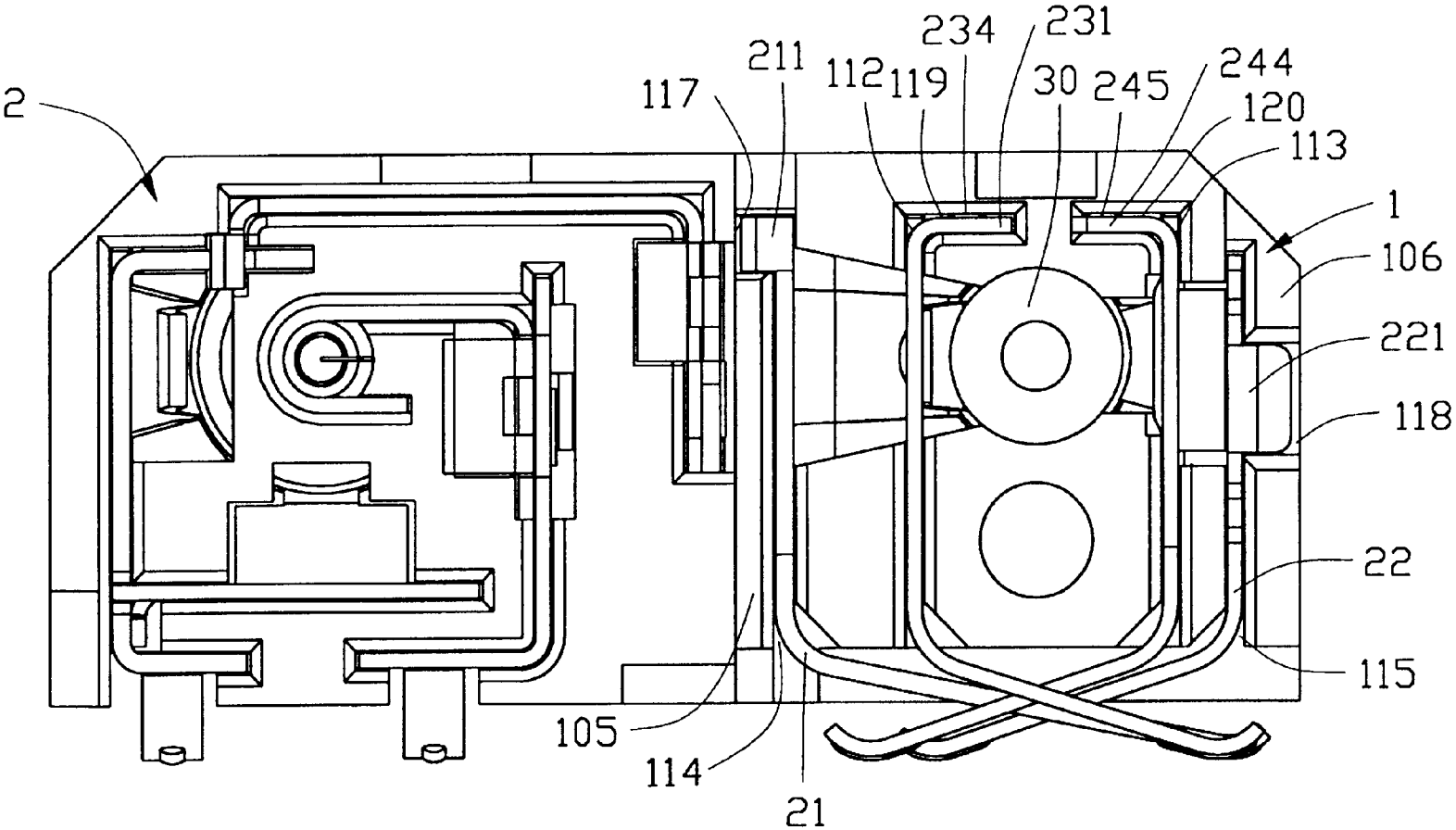
FIG. 2 is a front elevational view of FIG. 1, wherein the front cover of the electrical connector assembly is removed for clarity.

Referring to FIGS. 1 and 2, an electrical connector assembly comprises a power jack 2 and an audio jack 1 of the present invention.

The audio jack 1 according to the present invention comprises an insulating housing 10 defining a longitudinal plug-insertion hole and a contact assembly 20. The housing 10 includes a main body 101 and a sleeve 102 rearwardly extending from a rear face of the main body 101.

The main body 101 has a top wall 104, a first sidewall 105 and a second sidewall 106 opposite to the first sidewall 105. A slot 108 is defined in the top wall 104 beside an inner side of the first sidewall 105. A pair of cutouts 110 are respectively defined in opposite ends of the slot 108. A pair of narrow slits 109 are defined in the top wall 104 far from the sleeve 102. A pair of first channels 114, 115 are longitudinally defined in the inner sides of the sidewalls 105, 106. A pair of first retaining grooves 117, 118 are defined in front ends of the sidewalls 105, 106 and perpendicularly communicate with the first channels 114, 115. A pair of second channels 112, 113 are longitudinally defined in the inner side of the top wall 104 next to the first channels 114, 115. The slits 109 communicate with the second channels 112, 113. A pair of second retaining grooves 119, 120 respectively communicate with upper ends of the second channels 112, 113.

Figure 3:
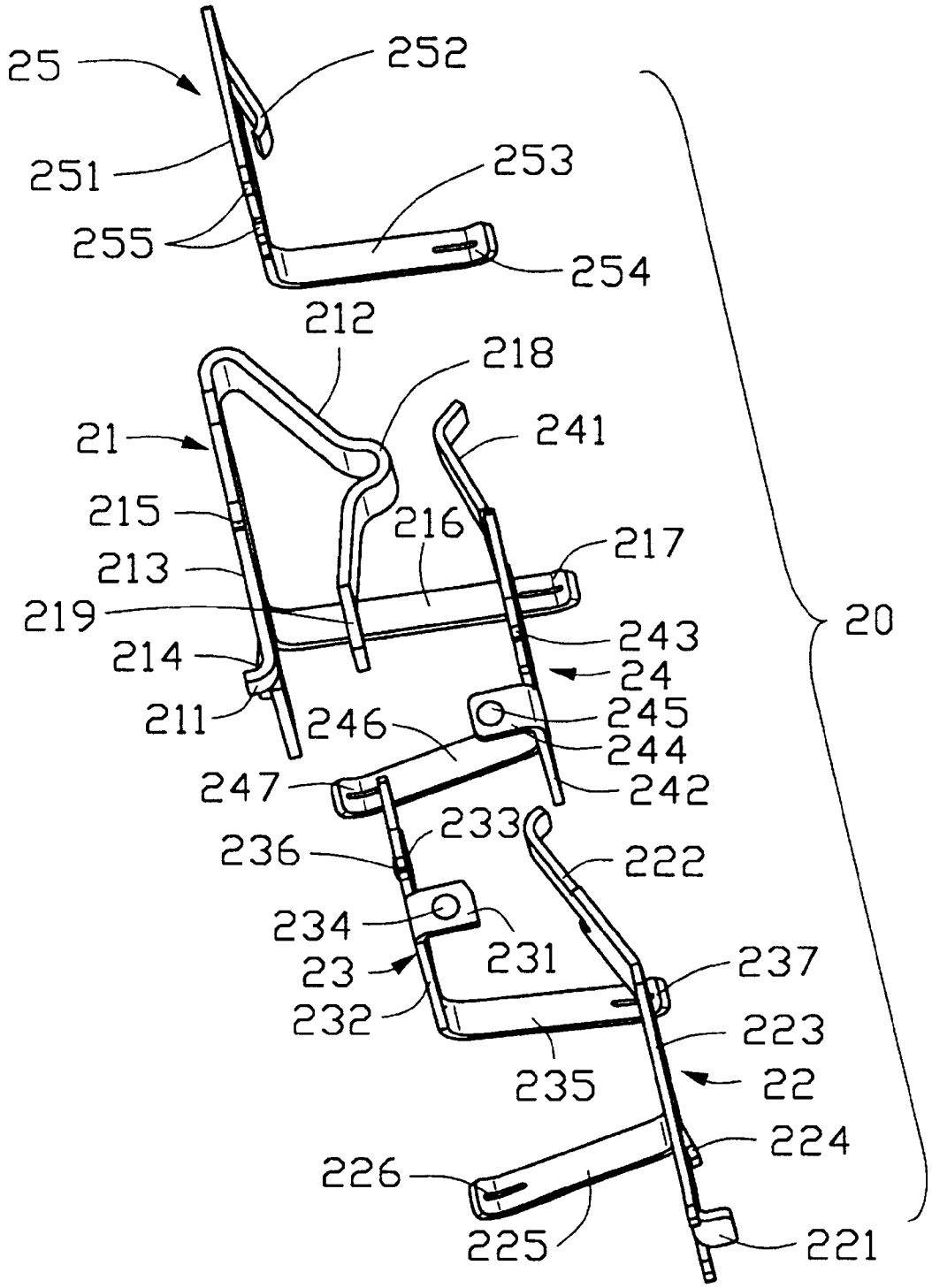
FIG. 3 is a perspective view of a plurality of contacts of the audio jack, particularly showing each contact separately.
Figure 4:
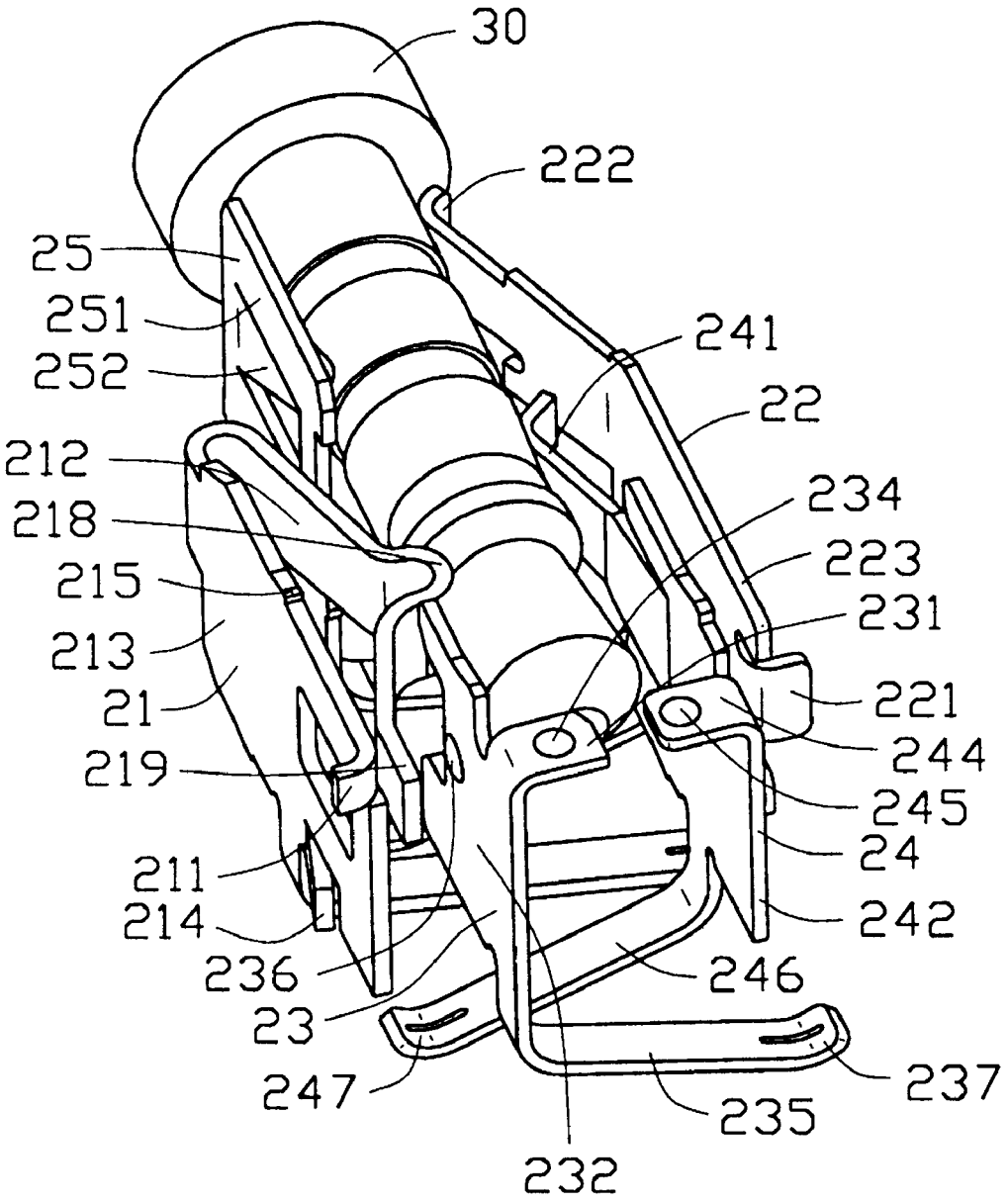
FIG. 4 is an assembled view of FIG. 3, wherein a mating plug is inserted, showing a connection between the plug and the contacts.
Figure 5:
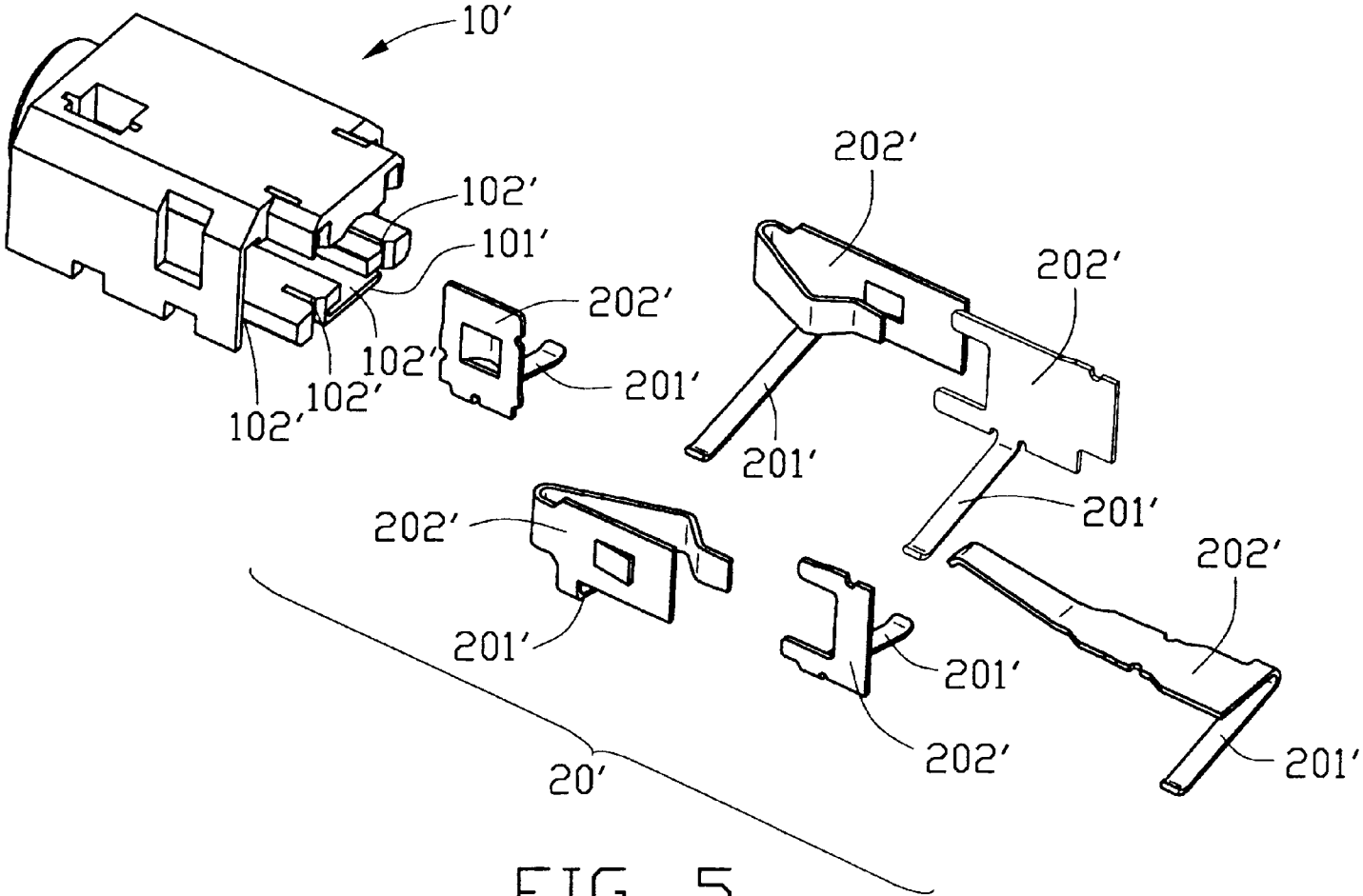
FIG. 5 (PRIOR ART)
FIG. 5 shows a conventional audio jack.

Referring to FIGS. 3 and 4, the contact assembly 20 includes a first contact 21, a second contact 22, a third contact 23, a fourth contact 24 and a fifth contact 25.

The first contact 21 comprises a substantially rectangular and planar base 213, a locating tab 211 outwardly extending from a front end of the base 213, a cantilevered spring contact arm 212 bent and reversely extending from an opposite end of the base 213, and a tail portion 216 downwardly and inwardly extending from a bottom end of the base 213. A substantially rectangular protrusion 214 is formed in approximately a middle of the base 213 for abutting against the housing 10. A barb 215 is formed on an upper end of the base 213 for abutting against the housing 10. The contact arm 212 forms a curve portion 218 in substantially a middle part thereof. A contact portion 219 extends from a free end of the curve portion 218 and is substantially parallel to the base 213. A contact tab 217 is formed at a distal end of the tail portion 216.

The second contact 22 comprises a substantially rectangular and planar base 223, a locating tab 221 outwardly extending from an front end of the base 223, and a tail portion 225 downwardly and inwardly extending from a bottom end of the base 223. A contacting protrusion 222 inwardly extends at an opposite end of the base 223. A substantially rectangular protrusion 224 is formed in approximately a middle of the base 223 for abutting against the housing 10. A contact tab 226 is formed on a distal end of the tail portion 225.

The third contact 23 is provided to cooperate with the contacting portion 219 of the first contact 21. The third contact 23 comprises a substantially rectangular and planar base 232, a locating tab 231 perpendicular to the base 232 inwardly extending from an upper end of the base 232, and a tail portion 235 downwardly and inwardly extending from a bottom end of the base 232. A barb 233 is formed on the upper end of the base 232 for abutting against the housing 10. A dome-shaped protrusion 236 projects from the base 232 for cooperating with the contacting portion 219 of the first contact 21 when the plug 30 is not inserted in the audio jack. A sustaining protrusion 234 upwardly projects from an upper surface of the locating tab 231. A contact tab 237 is formed at a distal end of the tail portion 235.

The fourth contact 24 comprises a substantially rectangular and planar base 242, a locating tab 244 perpendicular to the base 242 inwardly extending from an upper end of the base 242, and a tail portion 246 downwardly and inwardly extending from a bottom end of the base 242. A contacting protrusion 241 inwardly extends at a rear end of the base 242. A barb 243 is formed on the upper end of the base 242 for abutting against the housing 10. A sustaining protrusion 245 upwardly projects from an upper surface of the locating tab 244. A contact tab 247 is formed at a distal end of the tail portion 246.

The fifth contact 25 comprises a substantially rectangular and planar base 251 and a tail portion 253 downwardly and inwardly extending from a bottom end of the base 251. An arcuate arm 252 inwardly projects from the base 251 for biasing against the plug 30. The base 251 forms a pair of barbs 255 on opposite ends thereof for respectively latching with the corresponding cutouts 110 of the housing 10. A contact tab 254 is formed at a distal end of the tail portion 253.

In assembly, referring to FIGS. 1 and 2, the first contact 21 and the second contact 22 are respectively fixed in corresponding first channels 114 and 115. The protrusions 214 and 224 respectively latch in the housing 10 for retaining the first contact 21 and the second contact 22 in the housing 10. The barb 215 of the first contact 21 abuts against the housing 10 for retaining the first contact 21 in the housing 10. The locating tabs 211 and 221 are respectively received in and abut against the corresponding first retaining grooves 117 and 118 for securely retaining the contacts 21, 22 in the housing 10. The curve portion 218 of the first contact 21 and the contacting protrusion 222 of the second contact 22 project into the plug-insertion hole. The tail portions 216, 225 respectively extend downwardly and inwardly out of the housing 10.

The third contact 23 and the fourth contact 24 are respectively fixed in the corresponding second channels 112, 113. The barbs 233 and 243 are respectively retained in the corresponding slits 109. The locating tabs 231 and 244 respectively extend in the corresponding second retaining grooves 119, 120 for securely retaining the contacts 23, 24 in the housing 10. The contacting protrusion 241 projects into the plug-insertion hole of the housing 10. The tail portions 235, 246 each extend downwardly and inwardly out of the housing 10.

The fifth contact 25 is fixedly retained in the slot 108. The barbs 255 of the fifth contact 25 are respectively retained in the corresponding cutouts 110 of the slot 108 for securely retaining the fifth contact 25 in the housing. The tail portion 253 extends downwardly and inwardly out of the housing 10.

The contact tabs 217, 226, 237, 247 and 254 of the tail portions 216, 225, 235, 246 and 253 substantially lie in a common plane for electrically engaging with appropriate circuit traces on a top surface of a printed circuit board (not shown).

In use, the audio jack 1 is retained between the circuit board and a fixing portion of an electrical device, for example, a casing of a mobile phone, for fixing the housing of the audio jack. The fixing portion of the electrical device presses downwardly an upper surface of the audio jack so that the contact tabs 217, 226, 237, 247 and 254 electrically engage with the circuit traces on the top surface of the printed circuit board. The locating tabs 211, 221, 231 and 244 are retained respectively in the corresponding retaining grooves 117, 118, 119 and 120 for preventing undesired movement of the contacts 21, 22, 23 and 24 relative to the housing 10 in a top-to-bottom direction. The barbs 255 latch in the cutouts 110 of the housing 10 for preventing movement of the contact 25. In this way, the contacts 21, 22, 23, 24, 25 are motionlessly and securely retaining in the housing 10 without movement. The contact tabs 217, 226, 237, 247 and 254 lie in a common plane. So the connection between the each contact 21, 22, 23, 24 and 25 and the plug 30 is reliable.

When the plug 30 is inserted into the housing 10, the plug 30 pushes the curve portion 218 of the first contact 21 sideway and the contact portion 219 of the first contact 21 is deflected to move away from the dome-shaped protrusion 236 of the third contact 23, thereby breaking an electrical connection therebetween. The curve portion 218 of the first contact 21 contacts a constituent electrode of the plug 30 to establish an electrical connection between the plug 30 and the audio jack. At the same time, the contacting protrusion 222 of the second contact 22, the contacting protrusion 241 of the fourth contact 24 bear against the plug 30. The arcuate arm 252 of the fifth contact 25 abuts against the plug 30.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for being retained between a printed circuit board and a fixing portion of an electrical device, comprising:

an insulative housing having a top wall and opposite sidewalls, the housing defining a longitudinal plug-insertion hole, a plurality of contact-receiving grooves being defined in an inner side of the top wall and inner sides of the side walls in a top-to-bottom direction and parallel to the plug-insertion hole, and a plurality of retaining grooves perpendicularly communicating with front ends of the contact-receiving grooves; and a plurality of contacts received in the contact-receiving grooves, each contact including a base, a projecting portion projecting from the base to latch in the housing, and a tail portion downwardly and inwardly extending from the base for resiliently and electrically engaging with the circuit board, at least one of the plurality of contacts having a locating tab bent from the base thereof and retained in the retaining groove of the housing for preventing movement of the contact relative to the housing in the top-to-bottom direction.

2. The electrical connector as claimed in claim 1, wherein the retaining grooves are respectively defined at front ends of the sidewalls of the housing and communicate with substantially middle parts of the contact-receiving grooves, and wherein the at least one locating tab outwardly extends into the retaining groove.

3. The electrical connector as claimed in claim 1, further comprising a power jack including an insulative casing and a plurality of contacts received in the casing.

4. The electrical connector as claimed in claim 1, wherein the retaining grooves communicate with upper portion of the ends of the contact-receiving grooves, and wherein the at least one locating tab inwardly extends into the retaining groove.

5. The electrical connector as claimed in claim 4, wherein a protrusion projects from the at least one locating tab to abut against the retaining groove for securely retaining the at least one locating tab in the retaining groove.

6. An electrical connector assembly comprising:

an insulative housing defining a plug-insertion hole;

a plug inserted into plug-insertion hole;

a plurality of contact receiving grooves extending along a front-to-back direction inside the plug-insertion hole;

a plurality of retaining grooves perpendicularly communicatively located beside said contact receiving groove, respectively; a first set of contacts respectively disposed within the corresponding contact receiving grooves;

a second set of contacts respectively disposed within the correspo contact receiving grooves; wherein the first set of contacts is closer to the plug than the second set, and each of the first set of contacts has an inwardly extending locating tab received within the corresponding retaining groove while each of the second set of contacts has an outwardly extending locating tab received within the corresponding retaining groove; and wherein the locating tabs of each of the first set of contacts extends in a horizontal plane while the locating tabs of each of the second set of the contacts extends in a vertical plane.

* * * * *